US007273075B2

(12) United States Patent
Tapphorn et al.

(10) Patent No.: US 7,273,075 B2
(45) Date of Patent: Sep. 25, 2007

(54) BRUSH-SIEVE POWDER-FLUIDIZING APPARATUS FOR FEEDING NANO-SIZE AND ULTRA-FINE POWDERS

(75) Inventors: Ralph Tapphorn, Goleta, CA (US); Howard Gabel, Santa Barbara, CA (US)

(73) Assignee: Innovative Technology, Inc., Goleta, CA (US)

( * ) Notice: Subject to any disclaimer, the term of this patent is extended or adjusted under 35 U.S.C. 154(b) by 0 days.

(21) Appl. No.: 11/348,654

(22) Filed: Feb. 7, 2006

(65) Prior Publication Data

US 2007/0193646 A1 Aug. 23, 2007

Related U.S. Application Data

(60) Provisional application No. 60/650,598, filed on Feb. 7, 2005.

(51) Int. Cl.
*B65B 1/04* (2006.01)

(52) U.S. Cl. ..... 141/2; 141/18; 141/71; 141/286; 366/309; 366/312; 222/185.1

(58) Field of Classification Search ..... 141/71–74, 141/82, 2, 18, 286; 222/185.1, 189.02, 189.05; 366/309, 312
See application file for complete search history.

(56) References Cited

U.S. PATENT DOCUMENTS 902,577 A * 11/1908 Hall ..... 99/513
3,191,642 A * 6/1965 Saito ..... 141/128
3,386,416 A 6/1968 Wirth
4,349,323 A 9/1982 Furbish et al.
5,314,090 A 5/1994 Alexander
5,996,855 A 12/1999 Alexander et al.
6,000,446 A * 12/1999 Wegman et al. ..... 141/131
6,098,677 A * 8/2000 Wegman et al. ..... 141/256
6,513,739 B2 2/2003 Fritz et al.
6,620,243 B1 9/2003 Bertellotti et al.
6,715,640 B2 4/2004 Tapphorn et al.
2001/0010205 A1 8/2001 Rodenberger

* cited by examiner

*Primary Examiner*—Steven O. Douglas
(74) *Attorney, Agent, or Firm*—Lyon & Harr, LLP; Richard T. Lyon

(57) ABSTRACT

A powder-fluidizing apparatus is presented which is applicable to feeding ultra-fine and nano-size powders, and powders with a broad particle size distribution, in a uniform manner over a long period of time. Generally, this is accomplished by using a rotating brush to sweep the powder through holes in a removable sieve plate, which breaks up agglomerated particles in the powder and controls the powder feed rate. The powder then drops from the holes into a funnel, where it is fluidized by being entrained into a carrier gas, and then flows through the funnel out of the apparatus to an applicator. The funnel surface is vibrated to avoid powder build-up on the surface that can break loose and cause pulses of increased material in the powder flow. Ultrasonic waves are introduced into the funnel to break up any agglomerated particles remaining in the powder before it reaches the applicator.

22 Claims, 4 Drawing Sheets

BRUSH-SIEVE POWDER-FLUIDIZING APPARATUS FOR FEEDING NANO-SIZE AND ULTRA-FINE POWDERS

CROSS-REFERENCE TO RELATED APPLICATIONS

This application claims the benefit of a previously filed provisional patent application Ser. No. 60/650,598, filed on Feb. 7, 2005.

BACKGROUND

1. Technical Field

The present invention relates to a powder-fluidizing apparatus and process for feeding ultra-fine powders, including nano-size materials, and for feeding powders with a broad particle size distribution, in a uniform manner over a long period of time. The powders are fed into applicators such as coating and spray forming nozzles and guns.

2. Background Art

Several approaches currently exist for fluidizing powders. However, these approaches are designed for fluidizing larger particle sizes (e.g., particles larger than 635 mesh or 20 micrometers) and are not concerned with maintaining a consistent flow over a wide distribution of particle sizes within the fluidized stream.

In conventional powder feeders, ultra-fine powders, including nano-size materials, tend to agglomerate into larger size particles that do not feed uniformly through the feeder and frequently plug the feeder's orifices. Furthermore, conventional powder feeders don't maintain a constant flow over a wide distribution of powder particle sizes. An example is the vibrating powder feeder disclosed in U.S. Pat. No. 6,715,640 issued to Tapphorn and Gabel where ultra-fine powders like WC—Co tend to agglomerate into large clumps. Another example is the fluidized bed powder coating apparatus disclosed in U.S. Pat. No. 6,620,243 issued to Bertellotti et al. where the powder is agitated by gases introduced into the powder bed, causing individual particles to be pushed into a drag out space above the powder bed. This works well to fluidize the powder but it also tends to fluidize only the finer particles, thereby segregating the particle size distribution as it is injected into the fluidizing gas stream.

Several patents disclose flour sifter sieve apparatus that break up agglomerated powders and provide a uniform distribution of particle size, including for example, U.S. Pat. No. 6,513,739 issued to Fritz et al. These patents use wire loops or scrapers to move the powder across the sieve which works well for soft materials such as baking flour, but metal powders are much more abrasive and will quickly wear out either the sieve or the scraper.

Several patents disclose brush-type devices for feeding powders, including for example, U.S. patent application Pub. No. 20010010205 filed by Rodenberger on Mar. 5, 2001, U.S. Pat. No. 5,996,855 issued to Alexander et al., U.S. Pat. No. 5,314,090 issued to Alexander, and U.S. Pat. No. 4,349,323 issued to Furbish et al. These devices use brushes to collect powder between the bristles and subsequently discharge the powder into the gas stream by brushing across a scraper or another brush. This fluidizes the powder, but it does not break up small agglomerates into individual particles. U.S. Pat. No. 3,386,416 issued to Wirth uses a sieve electrode for electrostatically controlling the dispersion of flocking materials dispensed by adjacent cylindrical rotating brushes. Again the powder is discharged by the action of the brushes rubbing against each other. The sieve is used to apply an electric charge to the particles and is not used for metering powder and breaking up agglomerated powder particles. The brushes do not come in direct contact with the sieve.

Additionally, U.S. Pat. No. 4,349,323 uses a spiral shaped brush to advance the powder from the hopper to a funnel; the agglomerates then need to be broken with a rapidly rotating blade. This action tends to cause non-uniformity in the powder feed rate.

None of the aforementioned devices and methods involve brushing dry powder through a sieve plate for the purpose of both breaking up agglomerated powder particles and simultaneously fluidizing these particles into a carrier gas. U.S. Pat. No. 5,996,855 and U.S. Pat. No. 5,314,090 both teach a method for breaking up and dispensing powders by rotating two adjacent brushes at the funnel port of a hopper, however, neither of these patents discloses a method for brushing dry powders through a sieve plate for de-agglomeration and feeding into a fluidizing carrier gas.

It should be noted that, while specific shortcomings in conventional powder feeders are described above, the subject matter claimed below is not limited to implementations that solve any or all of these shortcomings.

SUMMARY

The present invention is directed toward a powder-fluidizing apparatus and process which are particularly applicable to feeding ultra-fine powders, including nano-size materials, and feeding powders with a broad particle size distribution, typically 0.1 micron to 50 micron in size, in a uniform manner over a long period of time. The powders are fed into applicators such as coating and spray forming nozzles and guns. The present invention is embodied in a powder-fluidizing apparatus and process that employ novel techniques for feeding the aforementioned types of powders.

More particularly, the present powder-fluidizing apparatus and process feeds the aforementioned types of powders by rotating a brush, in contact with a removable sieve plate, around the sieve plate, and sweeping the powder through holes in the sieve plate in order to break up agglomerated particles in the powder and control the feed rate of the powder to the applicator. The powder swept through the holes drops into a fluidizing funnel, where it is subsequently fluidized by being entrained into a carrier gas. The entrained powder and gas then flow through the funnel and into a hose attached to the present apparatus. The hose carries the entrained powder and gas to the applicator. The funnel surface is vibrated to avoid powder build-up on the surface that can break loose and cause pulses of increased material in the powder flow. Ultrasonic waves can be introduced into the funnel to break up any agglomerated particles remaining in the powder before it reaches the applicator.

It should be noted that this Summary is provided to introduce a selection of concepts, in a simplified form, that are further described below in the Detailed Description of the Preferred Embodiments. This Summary is not intended to identify key features or essential features of the claimed subject matter, nor is it intended to be used as an aid in determining the scope of the claimed subject matter. In addition to the just described benefits, other advantages of the present powder-fluidizing apparatus and process will become apparent from the detailed description which follows hereinafter when taken in conjunction with the drawing figures which accompany it.

DESCRIPTION OF THE DRAWINGS

The specific features, aspects and advantages of the present invention will become better understood with regard to the following description, appended claims, and accompanying drawings where:

DETAILED DESCRIPTION OF THE PREFERRED EMBODIMENTS

In the following description of the preferred embodiments of the present invention reference is made to the accompanying drawings which form a part hereof, and in which are shown, by way of illustration, specific embodiments in which the invention may be practiced. It is understood that other embodiments may be utilized and structural changes may be made without departing form the scope of the present invention.

In general, the present invention relates to a powder-fluidizing apparatus and process for feeding ultra-fine powders, including nano-size materials, and for feeding powders with a broad particle size distribution, in a uniform manner over a long period of time. The powders are fed into applicators such as coating and spray forming nozzles and guns. The present invention is embodied in a powder-fluidizing apparatus and process that employ novel techniques for feeding the aforementioned types of powders. These techniques will now be described in detail.

Figure 1:
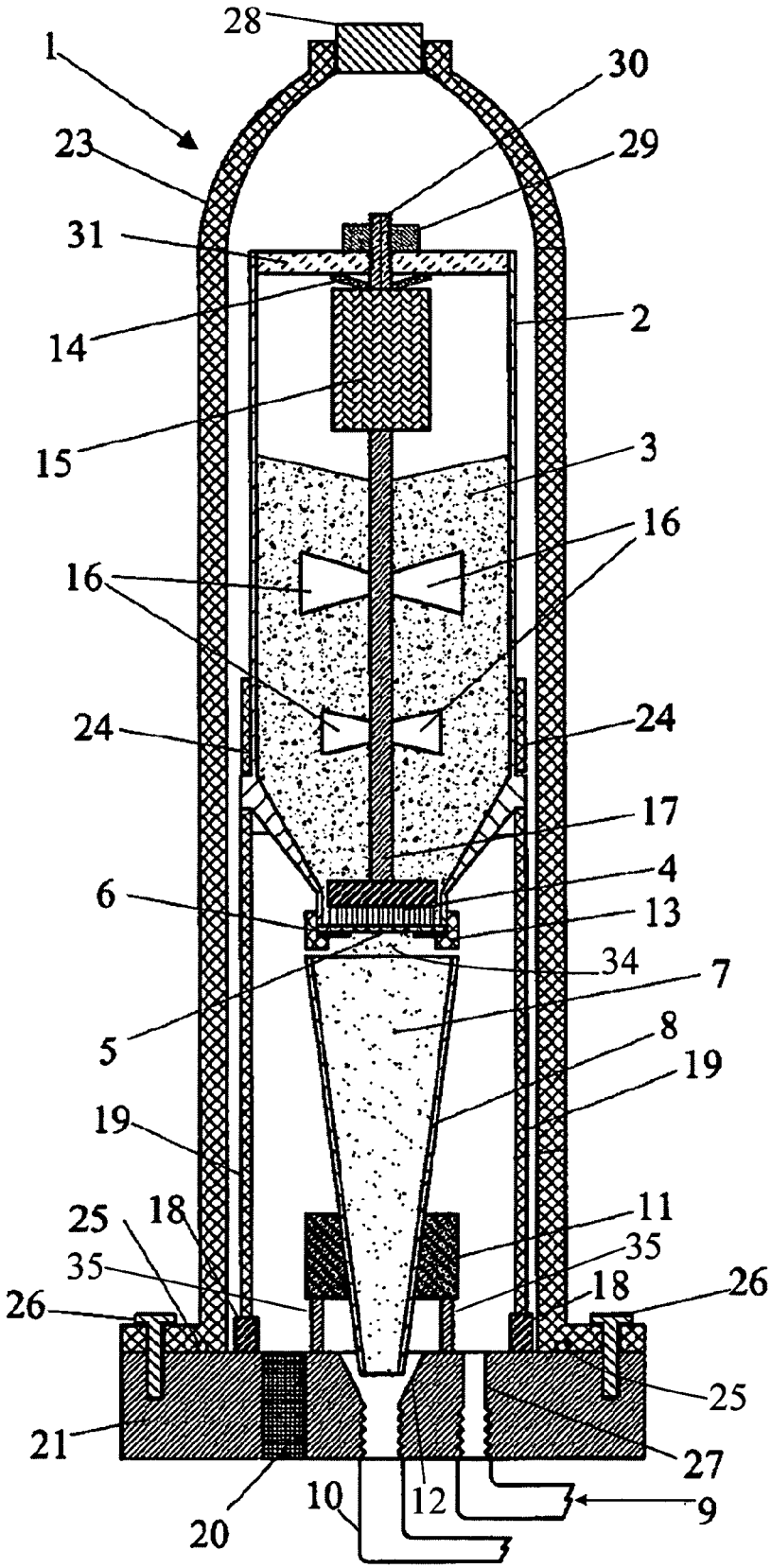
FIG. 1 shows an exemplary cross-section view of a powder-fluidizing apparatus according to the present invention.

FIG. 1 shows an exemplary cross-section view of a summary embodiment of the present powder-fluidizing apparatus 1. The apparatus 1 includes a pressure housing 23 with an opening on the top which is sealed by a removable plug 28. Bulk powder 3 is added to the apparatus 1 by removing the plug 28 and adding the powder 3 through the opening in the pressure housing. The pressure housing 23 is mounted on a base 21, is sealed to the base 21 with an o-ring 25, and is secured to the base 21 with fasteners 26. The seals created by the plug 28 and the o-ring 25 permit the pressure housing 23 to be pressurized. Internal to the pressure housing are included a hopper assembly 2 with a sieve plate 6 attached to an outlet on the bottom of the hopper assembly 2. One functional purpose for the sieve plate 6 is to retain the bulk powder 3 in the hopper assembly 2. Two other functional purposes for the sieve plate 6 are to breakup agglomerated particles in the powder 3, and to control the feed rate of the powder 3, both of which are discussed in detail below.

Referring again to FIG. 1, also internal to the pressure housing 23 is a motor with gearhead assembly 15, mounted inside the hopper assembly 2 above the bulk powder 3 to bracket 31. Electrical power is supplied to the motor with gearhead assembly 15 via an electrical feedthrough 20 in the base 21. The electrical wires associated with this supply of power are not shown. The motor with gearhead assembly 15 provides rotation of a brush 4 which is attached to the motor with gearhead assembly via a drive shaft 17. The drive shaft 17 additionally has vanes 16 located in various places on the shaft 17 which protrude from the shaft 17 inside the hopper assembly 2 at various depths into the bulk powder 3 for stirring the powder 3 and permitting gravitational feeding down through the hopper assembly 2 to the sieve plate 6. The rotating brush 4, in contact with the sieve plate 6, feeds the powder 3 and breaks up agglomerated particles in the powder 3 by sweeping the powder 3 through holes 5 in the sieve plate 6. The feed rate of the powder 3 is controlled by controlling the speed of the motor with gearhead assembly 15, which in turn controls the rotation speed of the drive shaft 17 and brush 4. Increasing the rotation speed of the brush 4 increases the feed rate of the powder 3, while decreasing the rotation speed of the brush 4 decreases the feed rate of the powder 3. In one embodiment of the present apparatus 1, the feed rate of the powder 3 can be precisely controlled using a variable speed DC, servo or stepper motor.

Referring yet again to FIG. 1, the sieve plate 6 is mounted into a holder 13 which tightens or locks the sieve plate 6 in place to prevent movement of the sieve plate 6 during rotation of brush 4. In a second embodiment of the present apparatus 1, the holder 13 permits removal of the sieve plate 6 and installation of an alternate sieve plate 6. This ability to exchange sieve plates 6 permits a new sieve plate 6 to be installed into the apparatus 1 when the existing sieve plate 6 becomes worn.

Figure 2:
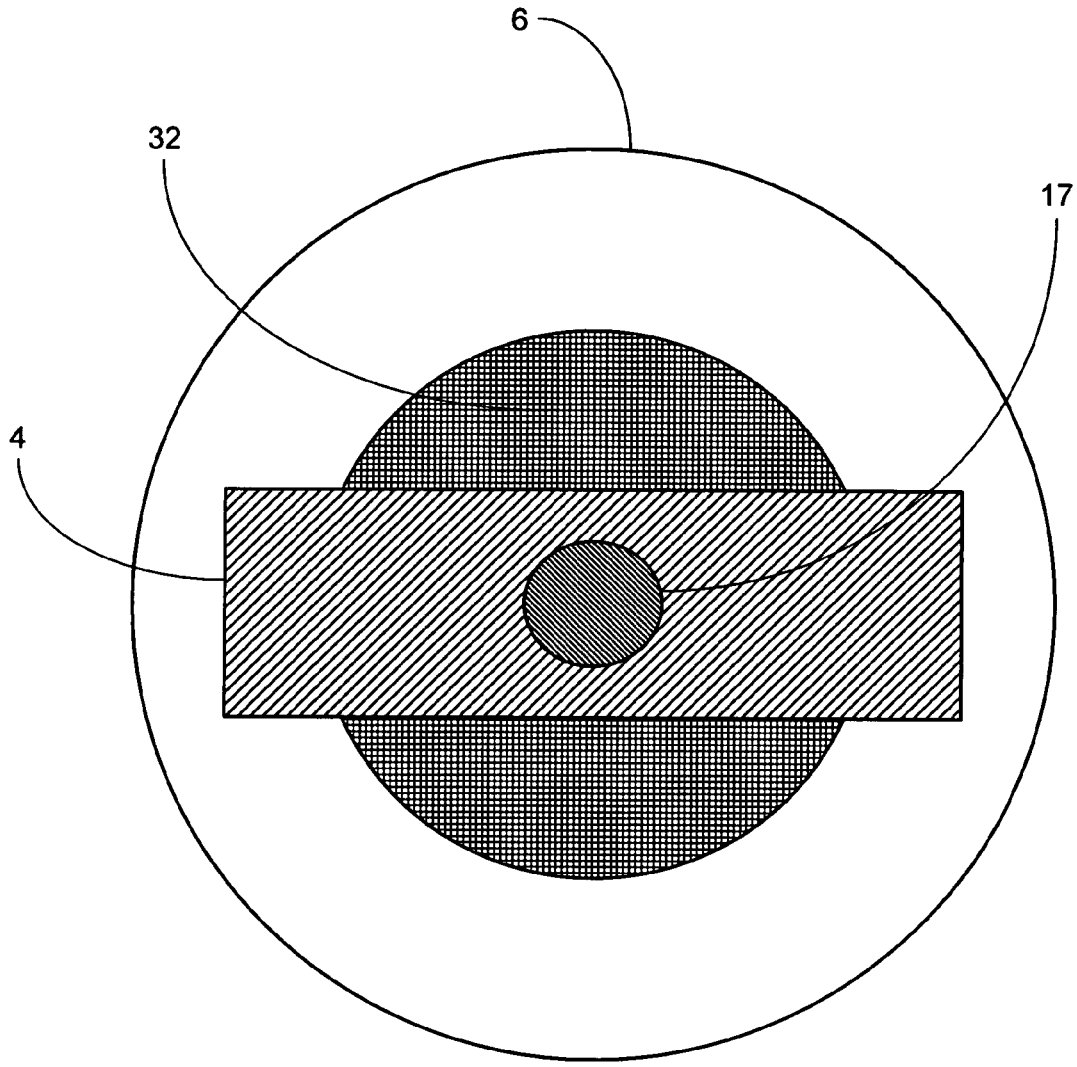
FIG. 2 shows an exemplary plan view of one type of sieve plate according to the present invention that utilizes a wire cloth.
Figure 3:
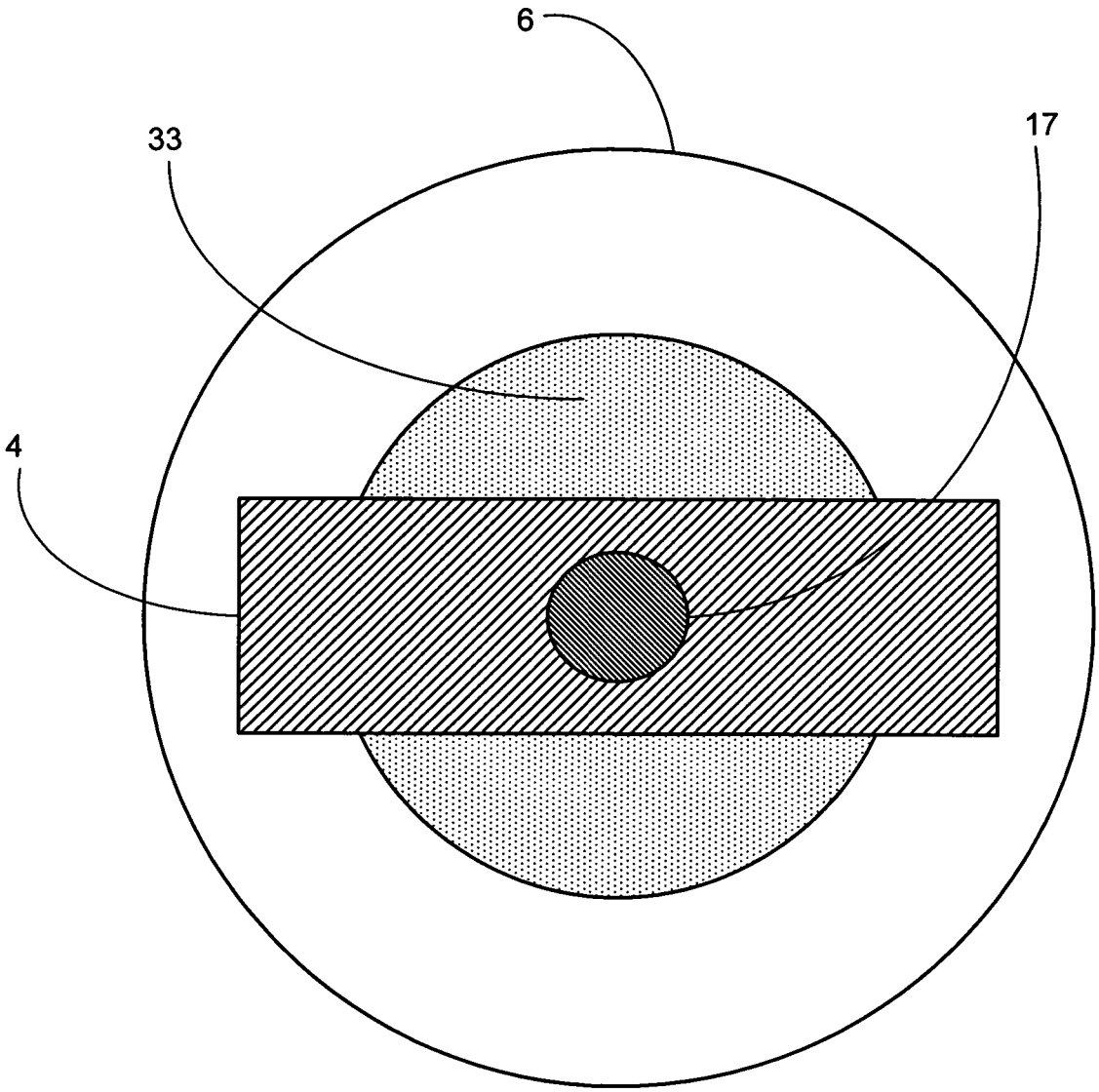
FIG. 3 shows an exemplary plan view of another type of sieve plate according to the present invention that utilizes a perforated disc.

Referring yet again to FIG. 1, in a third embodiment of the present apparatus 1, various sieve plate 6 structures and configurations can be selected for optimum feeding of different types of powders 3. Example variations in sieve plate 6 structures and configurations include variations in hole shape, hole size, hole pattern, and number of holes 5, among others. The sieve plate could be constructed from a wire cloth with various mesh sizes, or from a disc with discrete holes perforated into the disc. By way of further example but not limitation, FIG. 2 shows an exemplary plan view of one possible type of sieve plate 6 that utilizes a wire cloth 32 where the mesh pattern in the cloth 32 provides the holes 5. FIG. 3 shows an exemplary plan view of another possible type of sieve plate 6 that utilizes a perforated disc 33 where the perforations in the disc 33 provide the holes 5. An exemplary construction technique for these example sieve plates 6 is for the wire cloth 32 or the perforated disc 33 to be bonded to a washer with either epoxy or braze filler to provide structural integrity.

Referring yet again to FIG. 1, in a fourth embodiment of the present apparatus 1, the motor with gearhead assembly 15 is mounted outside the pressure housing 23 and the drive shaft 17 is extended through a rotary seal in the plug 28.

Referring yet again to FIG. 1, in a fifth embodiment of the present apparatus 1, an adjuster provides a way to adjust the force exerted by the brush 4 onto the sieve plate 6. For example, a spring mechanism 14 can be installed between the bracket 31 and the motor with gearhead assembly 15, and a nut 29 can be attached to a thread 30 on the drive shaft 17, whereby the nut 29 and thread 30 are located on the opposite side of the bracket 31 from the motor 15 and spring mechanism 14. Adjustment of the nut 29 results in an adjustment to the force exerted by the brush 4 onto the sieve plate 6. This adjustment feature is useful in order to maintain a constant force between the brush 4 and sieve plate 6, and to accommodate for operational wear of the brush 4 and sieve plate 6.

Referring yet again to FIG. 1, also internal to the pressure housing 23 is a fluidizing funnel 8, located underneath the hopper assembly 2 at a distance from the bottom side of the sieve plate 6, which collects the powder 34 after it is swept through the holes 5 in the sieve plate 6 and then drops from the bottom of the sieve plate via gravitational force. A carrier gas 9 is injected into an inlet port 27 on the base 21. Options for the carrier gas 9 include, but are not limited to, helium, nitrogen, argon, air, or mixtures thereof. The fluidizing funnel 8 is located at a distance from the bottom of the sieve plate 6 in order to allow a portion of the gas 9 to flow into a gap between the bottom of the sieve plate 6 and the top of the fluidizing funnel 8. This gas flow fluidizes the powder 34 by entraining the powder 34 as it drops from the bottom of the sieve plate 6. The entrained powder 7 is subsequently pneumatically conveyed by the gas 9 which continues to flow through the fluidizing funnel 8, through an outlet on the fluidizing funnel 8, and then into an outlet port 12 on the base 21. The remaining portion of the gas 9 flows into a gap between the outlet on the fluidizing funnel 8 and the outlet port 12 on the base 21, where it mixes with the aforementioned entrained powder 7 and gas 9 flowing out of the outlet on the fluidizing funnel. The entrained powder 7 and gas 9 are finally discharged from the pressure housing 23 through the outlet port 12 into a hose 10 attached to the outlet port 12, which carries the entrained powder 7 and gas 9 to an applicator. The pressure and flow rate of the carrier gas 9 are controlled outside the apparatus 1 by conventional gas regulators, flowmeters and metering valves (none of which are shown). The outlet port 12 of the apparatus 1 may also have an in-line valve such as a ball valve (not shown) for retaining gas pressure in the pressure housing whenever the applicator is idle or shutdown.

Referring yet again to FIG. 1, it is a salient feature of the present apparatus and process that the carrier gas 9 flows both into a gap at the top of the fluidizing funnel 8, as well as into a gap at the bottom of the fluidizing funnel 8 located between the outlet of the fluidizing funnel 8 and where this outlet enters the outlet port 12 on the base 21. If this feature was not present and all the gas 9 flowed only into the gap at the top of the funnel 8 and then into the top of the funnel 8, then a turbulent flow could result causing the powder 34 to escape and fume into the area outside of the funnel 8. Similarly, if this feature was not present and all the gas 9 flowed only into the gap at the bottom of the fluidizing funnel 8 and then into the outlet port 12 on the base 21, the powder 34 may not be uniformly entrained into the gas flow. Another salient feature of the present apparatus and process is that the carrier gas 9 flow rate is independent of the powder 3 feed rate, which is needed for many metallic spray processes including Kinetic Metallization as described in U.S. Pat. No. 6,915,964, and PCT Pat. Application WO 02/085532 A1 issued to Tapphorn and Gabel.

Referring yet again to FIG. 1, in a sixth embodiment of the present apparatus 1, an electromechanical vibrator 11 is attached to the outside of the fluidizing funnel 8 in order to ensure that powder does not accumulate on the surface of the funnel, which can result in non-uniform powder feeding as accumulated powder breaks lose in clumps from the funnel surface and is entrained into the carrier gas 9 as it passes through the funnel. In a seventh embodiment of the present apparatus 1, the vibrator 11 generates an ultrasonic wave inside the funnel 8 which serves to further break up any agglomerated particles remaining in the entrained powder 7 as it flows through the funnel 8. In both the sixth and seventh embodiments, electrical power is supplied to the vibrator via the electrical feedthrough 20. If the vibrator 11 is present in the apparatus 1, then both the fluidizing funnel 8 and attached vibrator 11 are mounted to the base 21 via supports 35. If the vibrator is not present, then the supports 35 could be attached directly to the funnel 8 (direct attachment not shown).

Referring yet again to FIG. 1, in an eighth embodiment of the present apparatus 1, the hopper assembly 2 can be mounted onto a load cell mechanism for measuring the residual powder 3 in the hopper, and for computing the powder mass flow rate of the powder 7 that is discharged from the apparatus 1. The load cell mechanism can include either a single load cell 18 or multiple load cells 18, which are mounted to the base 21. This is accomplished by mounting the hopper assembly 2 onto a ring stand (not explicitly shown) with supporting posts 19 which are attached through the load cell(s) 18. Electrical power is supplied to the load cell(s) 18 as needed, and signals are returned from the load cell(s) 18, via the electrical feedthrough 20. It is recommended that the wire harness (not shown) used for supplying electrical power and returning signals as needed from the various parts of the apparatus 1 inside the pressure housing 23 be sufficiently flexible and lightweight so as not to influence the load cell 18 mass measurements.

Referring yet again to FIG. 1, in a ninth embodiment of the present apparatus 1, a heater band 24 is mounted to the outside of the hopper assembly 2 in order to dry the bulk powder 3 before it is brushed through the sieve plate 6. Electrical power is supplied to the heater band 24 via the electrical feedthrough 20. Drying the powder 3 at prescribed temperatures (by way of example, in excess of 130° F.) aids in breaking up agglomerated particles in the powder 3 as the powder 3 is swept through the holes 5 in the sieve plate 6. This also aids in preventing the sieve plate 6 from possibly becoming plugged with a consolidated paste of the powder 3 as it is brushed across the sieve plate 6.

Referring yet again to FIG. 1, the brush 4 and sieve plate 6 could be constructed from various materials. In a tenth embodiment of the apparatus 1, the brush 4 and sieve plate 6 may be constructed from materials that are a constituent of the powder 3 to prevent any undesirable cross contamination of the powder 7 from occurring during wear of the brush 4 and sieve plate 6.

Referring yet again to FIG. 1, in an eleventh embodiment of the present apparatus 1, removable-type fasteners 26 are used to secure the pressure housing 23 to the base 21, permitting the housing 23 to be removed from the base 21 for various different reasons including but not limited to, maintaining, cleaning and servicing the apparatus 1, or exchanging sieve plates 6 as discussed above.

Figure 4:
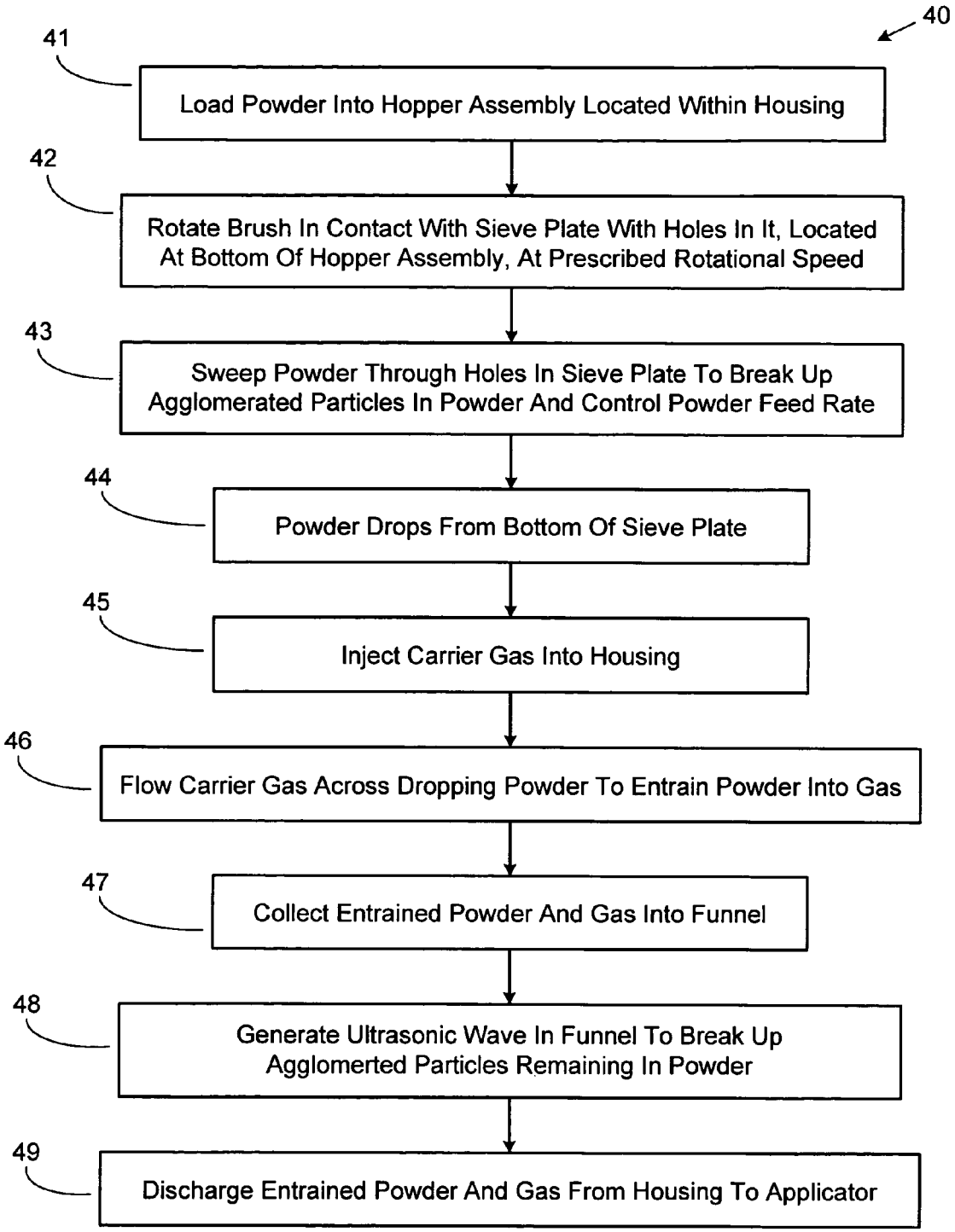
FIG. 4 shows an exemplary flow diagram of a powder-fluidizing process according to the present invention.

FIG. 4 shows an exemplary flow diagram of the present powder-fluidizing process 40 for feeding bulk powder into an applicator. The process starts by loading the bulk powder into a hopper assembly which is located within a housing 41. A brush that is in contact with a sieve plate with holes in it, which is located at the bottom of the hopper assembly, is rotated across the sieve plate at a prescribed rotational speed 42. The brush rotation sweeps the powder across and through the holes in the sieve plate, in order to break up agglomerated particles in the powder and control the feed rate of the powder 43. The powder that is swept through the holes in the sieve plate then drops from the bottom side of the sieve plate 44. In conjunction with the aforementioned process steps, a carrier gas is injected into the housing 45. The gas is then flowed across the dropping powder, in a gap between the bottom side of the sieve plate and the top of a fluidizing funnel, which is located underneath the sieve plate, at a distance from the sieve plate, in order to entrain the dropping powder into the gas 46. The entrained powder and gas are then collected into the funnel 47. An ultrasonic wave can be generated in the funnel in order to break up any agglomerated particles remaining in the powder before it reaches the applicator 48. Finally, the entrained powder and gas are discharged from an outlet on the funnel, to an outlet port on the housing, and then through a hose to the applicator 49.

It is anticipated that the present powder-fluidizing apparatus and process will be used by Kinetic Metallization systems such as U.S. Pat. No. 6,915,964, and PCT Patent Application WO 02/085532 A1 issued to Tapphorn and Gabel, "Cold Spray" systems disclosed by Alkhimov, et al. in U.S. Pat. No. B1 5,302,414, and by various types of thermal and plasma spray guns. In addition, the present powder-fluidizing apparatus and process could find applications in dry powder coating and dispersion devices.

The present powder-fluidizing apparatus and process were tested using a WC—Co17% powder 3 having an average particle size in the 1-5 micrometer range. Typically, this powder agglomerates such that it forms a semi-solid paste with a high degree of particle agglomeration. By drying the WC—Co17% powder in an inert gas and using the hopper heater band 24, the apparatus was able to uniformly feed the powder into a Kinetic Metallization system as disclosed in U.S. Pat. No. 6,915,964 issued to Tapphorn and Gabel, and PCT patent application Pub. No. WO 02/085532 A1 filed by Tapphorn and Gabel on Apr. 20, 2002. The feed rates for the WC—Co17% powder 3 were adjusted from 10-100 gram/minute by adjusting the rotating speed of the rotating brush 4 from 0.5 to 10 rpm. No build up of fluidized powder 7 on the fluidizing funnel surface 12 of the fluidizing funnel 8 occurred with carrier gas 9 flow rates of 3-5 SCFM helium while using the electromechanical vibrator 11. For this particular powder the sieve plate 6 was fabricated using a 40-mesh stainless steel wire cloth. The rotating brush 4 was fabricated using stainless steel bristles.

The present powder-fluidizing apparatus and process were also tested using a blend of aluminum and chromium Al50%—Cr50% (called Al-Trans®) powder 3 having an average particle size in the 1-45 micrometer range. This powder does not exhibit agglomerating characteristics and represents an example of using the powder-fluidizing apparatus 1 to feed free flowing powders. In this particular example Al50%—Cr50% (Al-Trans®) powder 3 was loaded into the hopper, and 40-mesh stainless steel wire cloth was also selected as the sieve plate 6. The rotation speed for the rotating brush 4 was set to approximately 3 rpm to yield a desirable feed rate of 30 grams/min for uniformly feed Al50%—Cr50% (Al-Trans®) powder 3 into the Kinetic Metallization system disclosed in U.S. Pat. No. 6,915,964, and PCT patent application Pub. No. WO 02/085532 A1.

It should be noted that any or all of the aforementioned alternate embodiments may be used in any combination desired to form additional hybrid embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Wherefore, what is claimed is:

1. A powder-fluidizing apparatus for feeding bulk powder into an external applicator, comprising:

a base comprising an inlet port and outlet port; and a pressure housing attached to the base, wherein the pressure housing internally comprises, a hopper assembly, comprising, a motor with gearhead assembly which is located at a top of the hopper assembly, a sieve plate with holes in it attached to an outlet on a bottom of the hopper assembly, a drive shaft, extending through the bulk powder, wherein a top of the drive shaft is attached to the motor with gearhead assembly, and a brush, which makes contact with the sieve plate, and which is attached to a bottom of the drive shaft, wherein the motor with gearhead assembly rotates the drive shaft and brush at a prescribed speed across the sieve plate, and the action of the brush rotating across the sieve plate sweeps the powder over and through the holes in the sieve plate, serving to break up agglomerated particles in the powder as they are swept through the holes, resulting in the powder dropping out of the holes from a bottom side of the sieve plate.

2. The apparatus of claim 1, wherein the pressure housing is attached to the base using removable fasteners allowing the pressure housing to be removed from the base.

3. The apparatus of claim 1, wherein the hopper assembly further comprises vanes attached to the drive shaft at prescribed locations along the shaft, wherein the vanes protrude from the shaft and serve to stir the bulk powder in the hopper assembly.

4. The apparatus of claim 3, wherein the vanes protrude from the shaft at various prescribed distances into the bulk powder to optimize the stirring and related gravitational feeding of the powder down through the hopper assembly to the sieve plate.

5. The apparatus of claim 1, wherein the motor with gearbox assembly comprises a variable speed type of motor, wherein the speed of the motor is varied in order to vary the rate at which the powder is entrained into a gas.

6. The apparatus of claim 1, wherein the brush and sieve plate are comprised of materials selected to prevent contamination of the powder resulting from wear as the brush rotates across the sieve plate.

7. The apparatus of claim 1, wherein the hopper assembly further comprises a heater band which is attached around the hopper assembly in order to heat and dry the bulk powder in the hopper assembly before the brush sweeps the powder through the holes in the sieve plate.

8. The apparatus of claim 1, wherein the holes in the sieve plate are selected as to at least one of their shape, size, pattern and number, so as to partially control the rate at which the powder drops out of the holes.

9. The apparatus of claim 1, wherein the sieve plate comprises a wire cloth material.

10. The apparatus of claim 1, wherein the sieve plate comprises a perforated disc.

11. The apparatus of claim 1, wherein the outlet on the bottom of the hopper assembly further comprises a sieve plate holder which tightens around the sieve plate to secure and prevent rotation of the sieve plate.

12. The apparatus of claim 11, wherein the sieve plate holder is reversibly releasable so as to enable the sieve plate to be removed from the holder and a replacement sieve plate installed.

13. The apparatus of claim 1, wherein the hopper assembly further comprises an adjuster for adjusting the force exerted by the brush onto the sieve plate.

14. The apparatus of claim 13, wherein the motor with gearhead assembly is attached to the top of the hopper assembly by a bracket, and wherein the adjuster comprises:

a spring mechanism located between the motor with gearhead assembly and the bracket; and a nut attached to a thread on the top of the drive shaft, wherein turning the nut serves to adjust the force exerted by the brush onto the sieve plate.

15. The apparatus of claim 1, wherein, the pressure housing further internally comprises a fluidizing funnel, located underneath the bottom side of the sieve plate, at a distance from the sieve plate, which collects the powder dropping from the sieve plate, wherein a carrier gas is injected into the pressure housing through the inlet port and flows into a gap between the bottom side of the sieve plate and the top of the funnel, such that, as the powder drops from the sieve plate through the gas, it is entrained into the gas and is then pneumatically conveyed by the gas through the funnel, to an outlet on the funnel, and then from the outlet on the funnel into the outlet port on the base, from which the powder and gas are discharged from the apparatus to the applicator.

16. The apparatus of claim 15, wherein a portion of the carrier gas flows between the outlet on the fluidizing funnel and the outlet port on the base.

17. The apparatus of claim 15, wherein the fluidizing funnel further comprises a vibrating device attached to the funnel which vibrates the funnel in order to prevent powder from accumulating on the surface of the funnel.

18. The apparatus of claim 17, wherein the vibrating device generates an ultrasonic wave inside the funnel which serves to further break up any agglomerated particles remaining in the powder entrained in the gas it flows through the funnel.

19. The apparatus of claim 1, wherein the hopper assembly is mounted onto a load cell mechanism, wherein the load cell mechanism is used to measure the weight of the bulk powder in the hopper, and to compute the mass flow rate of the powder discharged from the apparatus.

20. A powder-fluidizing apparatus for feeding bulk powder into an external applicator, comprising:

a base comprising an inlet port and outlet port;

a pressure housing attached to the base; and a motor with gearhead assembly located outside the pressure housing, wherein, there is an opening at a top of the pressure housing into which a plug is installed to seal the opening and the plug comprises a rotary seal, and the pressure housing internally comprises a hopper assembly, comprising, a sieve plate with holes in it attached to an outlet on a bottom of the hopper assembly, for holding the bulk powder in the hopper assembly above the sieve plate, a drive shaft, extending from outside the pressure housing, through the rotary seal, into the pressure housing, into the hopper assembly, and through the bulk powder, wherein a top of the drive shaft is attached to the motor with gearhead assembly, and a brush, which makes contact with the sieve plate, which is attached to a bottom of the drive shaft, wherein, the motor with gearhead assembly rotates the drive shaft and brush at a prescribed speed across the sieve plate, and the action of the brush rotating across the sieve plate sweeps the powder over and through the holes in the sieve plate, serving to break up agglomerated particles in the powder as they are swept through the holes, resulting in the powder dropping out of the holes from a bottom side of the sieve plate.

21. A powder-fluidizing process for feeding bulk powder into an applicator, comprising the process actions of:

loading the bulk powder into a hopper assembly which is located within a housing; and rotating a brush which is in contact with a sieve plate with holes in it located at the bottom of the hopper assembly, wherein, the brush is rotated across the sieve plate at a prescribed rotational speed in order to sweep the powder across and through the holes in the sieve plate, serving to break up agglomerated particles in the powder and control the feed rate of the powder, and the powder that is swept through the holes in the sieve plate drops from the bottom side of the sieve plate.

22. The process of claim 21, further comprising:

injecting a carrier gas into the housing so as to flow at least a portion of the gas across the dropping powder in a gap between the bottom side of the sieve plate and a top of a fluidizing funnel which is located underneath the sieve plate, at a distance from the sieve plate, thereby entraining the powder that drops from the bottom side of the sieve plate into the gas;

collecting the entrained powder and the gas into the funnel;

generating an ultrasonic wave inside the funnel in order to break up any agglomerated particles remaining in the powder before the powder reaches the applicator; and discharging the entrained powder and the gas from an outlet on the funnel, to an outlet port on the housing, and then through a hose to the applicator.

* * * * *